US009616974B2

(12) United States Patent
Martindale

(10) Patent No.: US 9,616,974 B2
(45) Date of Patent: Apr. 11, 2017

(54) AUGER ANCHOR

(71) Applicant: David Eugene Martindale, Aurora, CO (US)

(72) Inventor: David Eugene Martindale, Aurora, CO (US)

( * ) Notice: Subject to any disclaimer, the term of this patent is extended or adjusted under 35 U.S.C. 154(b) by 0 days.

(21) Appl. No.: 15/046,236

(22) Filed: Feb. 17, 2016

(65) Prior Publication Data

US 2016/0236754 A1 Aug. 18, 2016

Related U.S. Application Data

(60) Provisional application No. 62/117,673, filed on Feb. 18, 2015.

(51) Int. Cl.
*B63B 21/26* (2006.01)
*E02D 5/80* (2006.01)

(52) U.S. Cl.
CPC ..... *B63B 21/26* (2013.01); *E02D 5/801* (2013.01)

(58) Field of Classification Search
CPC ..... B63B 21/26; E02D 5/80; E02D 5/801
USPC ..... 52/157, 165, 741.1; 114/295
See application file for complete search history.

(56) References Cited

U.S. PATENT DOCUMENTS 3,662,436 A * 5/1972 Roza ..... E02D 5/801 24/115 R
4,387,483 A * 6/1983 Larrabee ..... E02D 5/801 16/422
5,010,698 A * 4/1991 Hugron ..... E02D 5/805 135/118
5,271,196 A * 12/1993 Fanti ..... E04H 12/2246 135/16
5,613,458 A * 3/1997 Owen ..... B63B 21/26 114/230.1
6,202,368 B1 * 3/2001 Wallace, III ..... E02D 5/801 248/156
7,090,437 B2 * 8/2006 Pinkleton ..... E02D 5/801 405/244
9,016,225 B1 * 4/2015 Jenkins ..... B63B 21/24 114/230.1
9,499,951 B2 * 11/2016 Levey ..... E21D 20/02
9,499,998 B2 * 11/2016 Bardelli ..... E02D 5/80
2011/0036024 A1 * 2/2011 Reinhardt ..... B63B 21/26 52/157

FOREIGN PATENT DOCUMENTS

FR 2689153 A1 * 10/1993 ..... E02D 5/805

* cited by examiner

*Primary Examiner* — Charles A Fox
*Assistant Examiner* — Joseph J Sadlon
(74) *Attorney, Agent, or Firm* — Kilpatrick Townsend & Stockton LLP

(57) ABSTRACT

An anchor device and method for safely and reliably securing watercraft to the bed of a body of water is provided. The anchor device may include a handle member with detachable components and an auger. The auger may be bored into the ground upon rotation of the handle member and then detached from the handle member by lifting the handle member vertically. The auger may include a shaft with a square cross-section and a pointed bottom end. Two auger blades, separated by an axial gap, may be attached to the shaft. Each auger blade may extend circumferentially around the shaft in a helical configuration.

16 Claims, 10 Drawing Sheets

AUGER ANCHOR

BACKGROUND OF THE INVENTION

An anchor is typically used to connect a vessel to the bed of a body of water to prevent the vessel from moving due to wind, current, or other conditions. Boat anchors may be temporary or permanent. Temporary anchors are those that may be detached and relocated whereas permanent anchors are rarely moved, such as a mooring. Most temporary anchors comprise a device that achieves holding power either by some type of "hooking" into the bed of a body of water, via sheer mass, or by a combination of the two. The device is attached to a rope or chain which is secured to the vessel to prevent movement.

BRIEF SUMMARY OF THE INVENTION

In one aspect of the present invention, an anchor device for anchoring one or more objects to the ground is provided. The anchor device may include a shaft with a bottom end and a top end. The top end of the shaft may have a square cross-section, and the bottom end of the shaft may be pointed. The anchor device may also include a handle member that is removably attached to the top end of the shaft. The handle member may be operable by a user to rotate the shaft. The handle member may have a square cross-section that matingly engages with the square cross section of the top end of the shaft.

The anchor device may further include a first auger blade attached to the shaft near the bottom end thereof. The first auger blade may extend circumferentially around the shaft in a helical configuration. The anchor device may include a second auger blade attached to the shaft near the top end thereof. The second auger blade may also extend circumferentially around the shaft in a helical configuration. The second auger blade may be separated from the first auger blade by an axial gap.

The anchor device may include an attachment member attached to the shaft at a location that is within 20% of the top end along an axial length of the shaft. The attachment member may be attachable to a rope or other securement member. The anchor device may further include a shaft guard attached to the shaft so as to surround the top end of the shaft without covering the top end such that the handle member is matingly engagable with the top end of the shaft while the shaft guard is attached to the shaft. In some embodiments, the shaft, the first auger blade, and the second auger blade form an auger that bores into the ground upon rotation of the shaft to create a static anchor point for an object attached to the rope or other securement member.

In some embodiments, the shaft guard has a conical shape with an open end that faces the top end of the shaft and an attached end that attaches to the shaft. The shaft guard may be positioned about the shaft so that the conical shape directs the handle member to matingly engage with the top end of the shaft. In some embodiments, the attached end of the shaft guard includes an aperture or other opening that allows fluid access to an interior region of the shaft guard from axially below the attached end. In some embodiments, the handle member includes a horizontal component and a vertical component. The vertical component may have a top end and a bottom end that includes the square cross-section. The horizontal component may be removably coupleable with the vertical component to form a handle that is graspable by a user to rotate the shaft.

In some embodiments, the vertical component includes a hollow interior within which the horizontal component is insertable. In some embodiments, the attachment member is coupled with the shaft so as to extend orthogonally from the shaft. In some embodiments, the attachment member comprises an eye bolt. In some embodiments the anchor device further includes a rope having a first end and a second end. The first end of the rope may be secured to the eye bolt and the second end of the rope may be securable to the object. In some embodiments, the shaft include a square cross-section along its entire axial length. At least a portion of an inner edge of the first auger blade and the second auger blade may not contact an outer surface of the shaft. In some embodiments, the anchor device is free of a mechanical fastener that couples the handle member and the top end of the shaft.

In a second aspect of the present disclosure, an anchor device for anchoring one or more objects to the ground is provided. The anchor device may include a shaft with a bottom member and a top member. The top member may be removably coupleable with the bottom member. The top member may define a handle that is operable by a user to rotate the bottom member. The anchor device may also include at least one auger blade that is attached to the bottom member of the shaft near a bottom end thereof. The at least one auger blade may extend circumferentially around the shaft in a helical configuration. The anchor device may further include an attachment member attached to the shaft near a top end of the bottom member of the shaft. The attachment member may be attachable to a rope or other securement member.

In some embodiments, the bottom member of the shaft and the at least one auger blade form an auger that bores into the ground upon rotation of the bottom member to create a static anchor point for an object attached to the rope or other securement member. In some embodiments, the anchor device is free of a mechanical fastener that couples the top member and the bottom member of the shaft. The anchor device may further include an additional auger blade attached to the bottom member of the shaft near the top end thereof. The additional auger blade may extend circumferentially around the shaft in a helical configuration. The additional blade may be separated from the at least one auger blade by an axial gap.

In some embodiments, the anchor device includes a shaft guard attached to the bottom member of the shaft so as to surround the top end of the bottom member without covering the top end such that the top member is matingly engagable with the top end of the bottom member while the shaft guard is attached to the bottom member.

In a third aspect of the present disclosure, a method of anchoring an object is provided. The method may include an anchor device. The method may also include rotating the top member of the shaft to rotate the bottom member and thereby bore the bottom member of the shaft into the ground via the at least one auger blade. The method may further include securing a first end of a rope to the object. In some embodiments, the method may include securing a second end of the rope to the attachment member to anchor the object to the ground. In some embodiments, the method may include uncoupling the top member from the bottom member. The method may also include boring the bottom member into the ground so that a top end of the bottom member is within 10 inches of the ground surface. The method may further include removing a horizontal component of the top member and inserting the horizontal component within the hollow bore of a vertical component of the top member.

In some embodiments, the anchor device may include an additional auger blade attached to the bottom member of the shaft near the top end thereof. The additional auger blade may extend circumferentially around the shaft in a helical configuration. The additional blade may be separated from the at least one auger blade by an axial gap. In some embodiments, the anchor device further comprises a shaft guard attached to the bottom member of the shaft so as to surround the top end of the bottom member without covering the top end of the bottom member such that the top member is matingly engagable with the top end of the bottom member while the shaft guard is attached to the bottom member.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the invention. No attempt is made to show structural details of the invention in more detail than may be necessary for a fundamental understanding of the invention and various ways in which it may be practiced.

Figure 1:
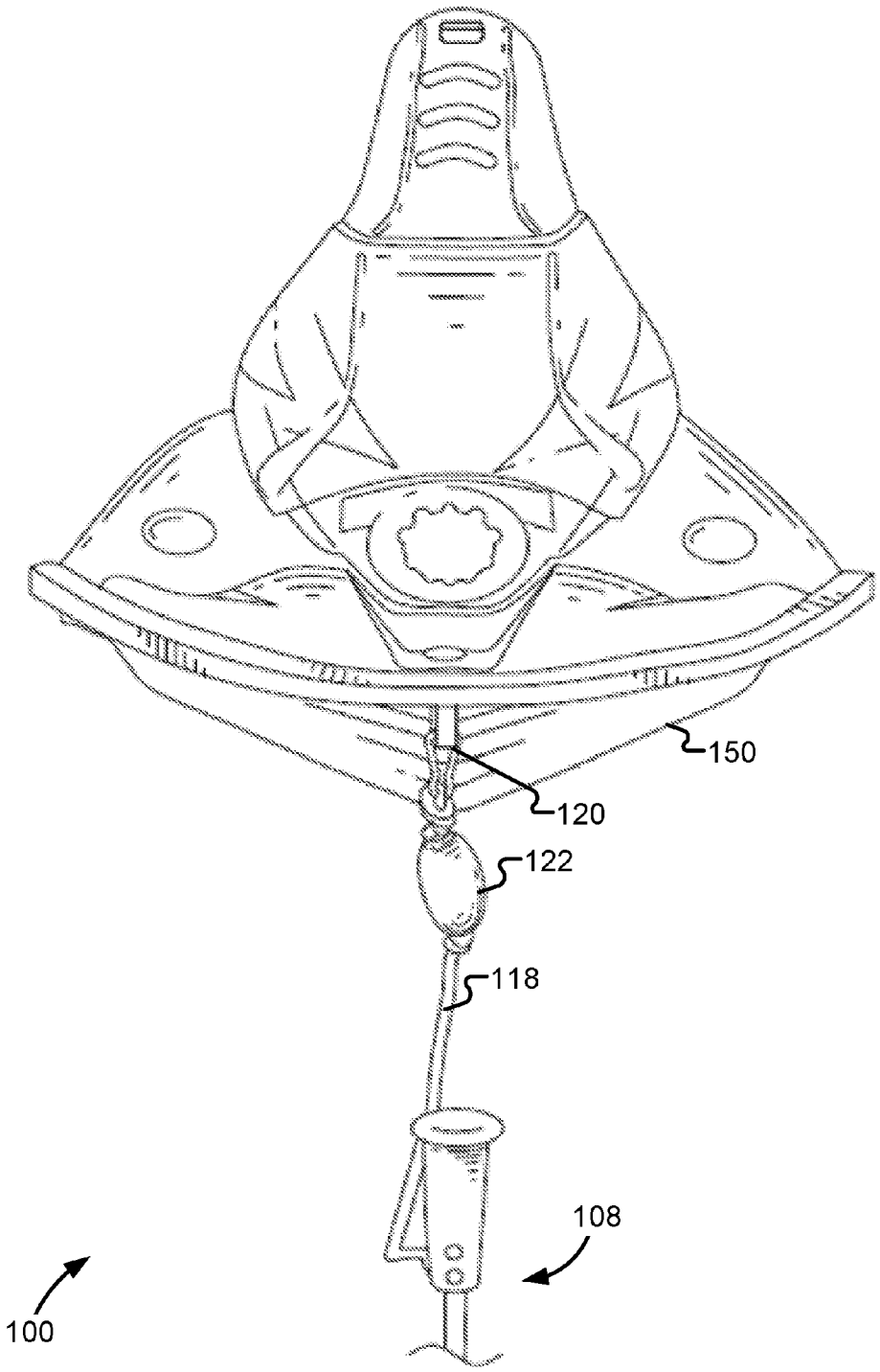
FIG. 1 illustrates a perspective view of an anchor device for anchoring one or more objects to the ground, according to an embodiment of the present disclosure.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

Various example embodiments of the present disclosure will be described below with reference to the drawings constituting a part of the description. It should be understood that, although terms representing directions are used in the present disclosure, such as "front", "rear", "upper", "lower", "left", "right", and the like, for describing various exemplary structural parts and elements of the present disclosure, these terms are used herein only for the purpose of explanation and are determined based on the orientations shown in the drawings. Since the embodiments disclosed by the present disclosure can be arranged according to different directions, these terms representing directions are merely used for illustration and should not be regarded as limiting. Wherever possible, the same or similar reference marks used in the present disclosure refer to the same components.

Unless defined otherwise, all technical terms used herein have the same meanings as commonly understood by one of ordinary skill in the art to which the invention pertains. The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals reference similar parts throughout the several views of the drawings.

Embodiments of the present disclosure provide a method of quickly, safely, and reliably anchoring objects to the ground. Anchoring of objects is achieved via an anchor device that includes a handle member and an auger member. The auger member is configured to bore into the ground upon rotation of the handle member. With the auger member bored into the ground a rigid anchor point is created. The handle member may then be detached from the auger member and an object may be tied, tethered, or otherwise coupled with the auger member. While the anchor device may be used to anchor virtually any object to the ground, the anchor device may be particularly useful in anchoring watercraft or other aqueous vessels to the ground. For ease in describing the various embodiments herein, the anchor device will be described as anchoring boats, watercraft, or other aqueous vessels to the ground, and more commonly to the bed of a body of water. It should be realized, however, that the anchor device may be used in non-aqueous environments to anchor objects to the ground. For example, the anchor device may be used to anchor RVs, trailers, ATVs, and the like to the ground, or may be used to anchor inflatable structures (e.g., a "bounce house"), temporary shelters, portable restrooms, and the like to the ground to prevent these structures from moving or toppling due to wind, seismic events, excessive vibration, and the like.

In aqueous environments, it may be beneficial to uncouple the handle member and the auger member to ensure that the handle member, or a portion thereof, does not remain exposed above the water's surface. In some embodiments, the handle member may be uncoupled from the auger member by lifting the handle member vertically. The anchor device may include features that allow the two separate members to be easily aligned and coupled even when the auger member is positioned under murky water. Having briefly described various features of the anchor device, additional aspects will be readily recognized in reference to the description of the various figures provided herein below.

Turning now to FIG. 1, illustrated is a perspective view of an anchor device 100 for anchoring one or more objects to the ground. Specifically, FIG. 1 illustrates a watercraft 150 secured to the bed of a lake via an auger member 108 of the anchor device or system 100. The watercraft 150 is attached to the auger member 108 via a connector 120 and a securement member 118, such as a rope or tether. The watercraft 150 may be any one of a wide range of water-borne vessel, including ships, boats, personal watercraft, inflatable water toys, hovercraft, submarines, and the like. In other embodiments, the object 150 may be not be a watercraft or water-borne vessel, but may be any land-based object, such as an RV, tent, trailer, inflatable object, portable restroom, and the like. In aqueous environments, it may be useful to include a float 122 on one end of the securement member 118 to enable a user to easily locate the securement member 118 on the surface of the water, such as after the watercraft 150 is detached from the securement member 118.

The connector 120 may be any one of a wide range of connecting devices, including a carabiner (as shown), a strap, a hook, a rope, a chain, an adhesive, and the like. The securement member 118 may be any one of a wide range of devices, including a rope (as shown), a chain, a cord, a cable, a rod, a tether, a tie, and the like.

Figure 2:
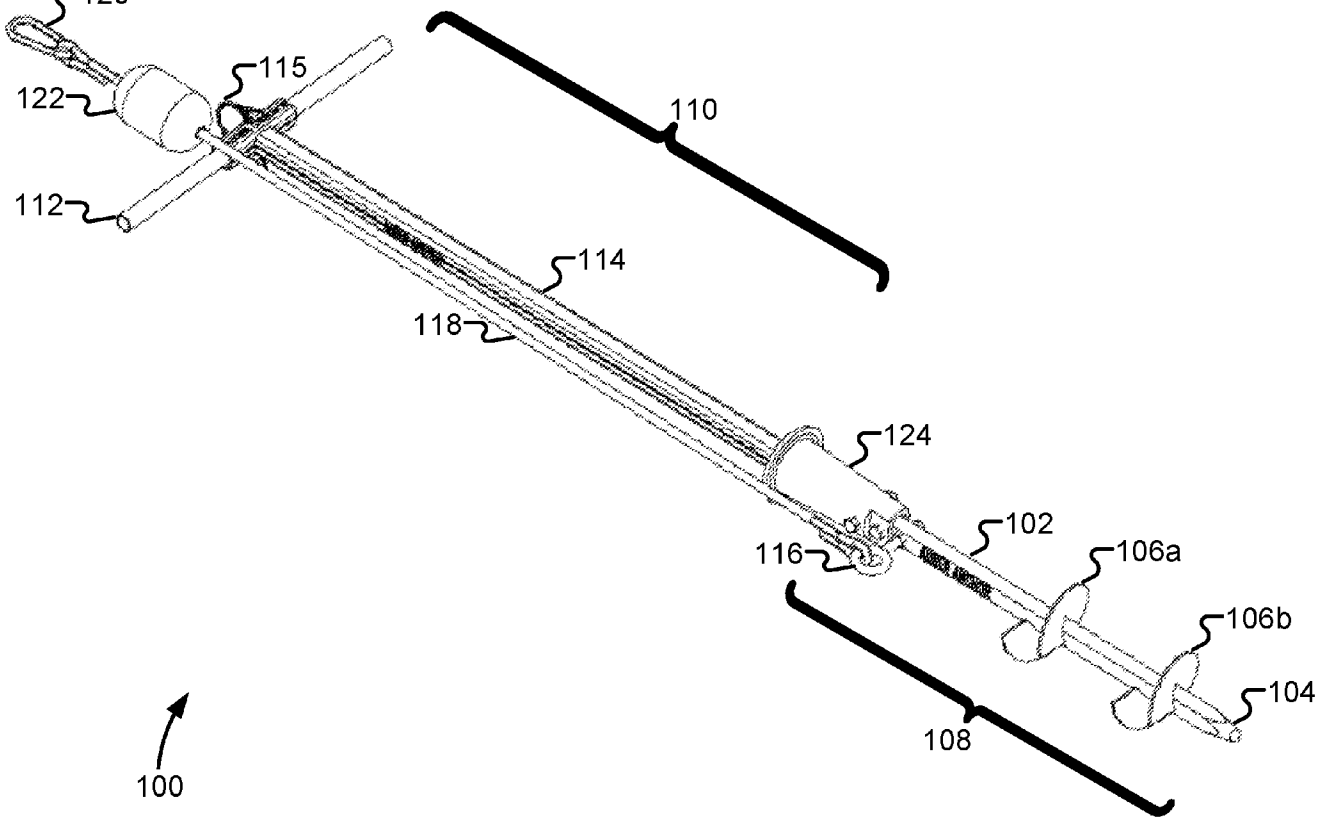
FIG. 2 illustrates an assembled, perspective view of the anchor device of FIG. 1.

FIG. 2 illustrates an assembled, perspective view of the anchor device 100. As illustrated, the anchor device 100 comprises a handle member 110 that may be removably attached to an auger member 108.

The handle member 110 comprises a gripping component 112 (also described herein as a horizontal component 112) and a main shaft component 114 (also described herein as a vertical component 114). The grip component 112 may be attached to the main shaft component 114 such that rotation of the grip component 112 about an axis of the main shaft component 114 causes the main shaft component 114 to rotate in a corresponding direction. In some embodiments, the grip component 112 is inserted within a hollow tube or cylinder that is attached to a proximal end of the main shaft component 114. The hollow tube or cylinder may be disposed at a roughly 90 degree angle relative to the main shaft component so as to maximize the torque that is transmitted to the main shaft component 114 upon rotation of the grip component 112. As described herein below, the grip component 112 may be releasably locked to the main shaft component 114 via a locking pin 115 or other mechanical fastener.

In some embodiments, a body of the main shaft component 114 may have a square cross section. This square cross section body of the main shaft component 114 may offer a variety of advantages over conventional circular shaft bodies. For example, the square cross section may allow the handle member 110 to effectively transfer torque to the auger member 108 without the use of various pins or mechanical fasteners. Specifically, the body of the main shaft component 114 may be hollow and a body or shaft 102 of the auger member 108 may have a square cross section which is size slightly smaller than an inner lumen of the main shaft component 114. As such, the auger member's body may be inserted within the inner lumen of the main shaft component 114. The square cross sectional profiles of the auger member 108 and the main shaft component 114 ensures that any rotational input or torque from the main shaft component 114 is transferred to the auger member 108. The geometrical engagement of the two components also ensures that a pin or other component is not required to transfer torque, as is often required in cylindrical shaped members since the inner cylindrical member may spin within an inner lumen of the outer cylindrical member. This advantage (i.e., not requiring a pin or mechanical fastener to transmit torque) may be especially useful when the anchor device 100 is used in aqueous environments since a user may easily uncouple the main shaft component 114 and auger member 108 without bending over and/or being submerged in water to remove a pin or mechanical fastener. The absence of a pin or mechanical fastener likewise allows the main shaft component 114 and auger member 108 to be reattached or coupled without requiring the user to bend over and possibly submerge themselves to attach the pin or mechanical fastener. Rather, the main shaft component 114 may simply be inserted over the body of the auger member 108 to ready the device for anchoring into the ground or removing the device therefrom.

The square cross sectional shape of the main shaft component 114 and auger member 108 also enables the shaft 102 of the auger member 108 to matingly engage with the body of the main shaft component 114. As describe above, the main shaft component 114 may have a larger cross section than the shaft 102 of the auger member 108, which allows the shaft 102 to be easily inserted within the inner lumen of the main shaft component 114. In other embodiments, the shaft 102 may have a larger cross section than the body of the main shaft component 114 so that the main shaft component 114 is inserted within an inner lumen of the shaft 102.

The square cross section of the auger member's shaft 102 may also improve the ease of manufacturing the anchor device 100. Specifically, the auger blades 106 may be more easily welded and/or attached to the shaft 102, such as by spot welding portions of the auger blade 106 that contact the shaft 102. The square cross section of the shaft 102 may further maintain or hold the auger blades 106 in a helical configuration due to an interference fit between the circular inner surface of the auger blades 106 and the square exterior surface of the shaft 102.

As illustrated in FIG. 2, in some embodiments the handle member 110 may have a longer axial or longitudinal length than the auger member 108. The longer axial length of the handle member 110 may be particularly important or useful in aqueous environments since the longer handle member 110 may allow the user's head and/or hands to remain above water while the auger member 108 is bored into the lake bed. In some embodiments, the handle member 114 may have a length that is approximately 1.5, 2, 2.5, or 3 times greater than the length of the auger member 108. In some embodiments, the handle member 114 may be made of multiple axial members or tubes (not shown) that elongate in a telescoping fashion so that the axial length of the handle member 114 is adjustable to a desired length. The multiple members or tubes may be fixed in one of several axial length positions via a mechanical fastener, detents, and the like. Although the longer handle member 110 may be useful, it should be realized that in other embodiments, the handle member 110 and auger member 108 may have approximately equal length, or the auger member 108 may be longer than the handle member 110.

In a specific embodiment, the main shaft component 114 may have an axial length of between about 20 and 40 inches, and more commonly about 30 inches. In other embodiments, the axial length of the main shaft component 114 may be 20 inches, 25 inches, 35 inches, 40 inches, and the like. The main shaft component 114 may have a cross-section width of between about 0.5 and 2 inches, and commonly about 1.0 inch. The grip component 112 may have an axial length of between about 10 and 20 inches, and more commonly about 15 or 16 inches. The shaft 102 may have an axial length of between about 10 and 30 inches, and more commonly between 20 and 25 inches. In a specific embodiment, the shaft has a length of approximately 24 inches. The shaft 102 may have a width of between ½ and 2 inches, and more commonly about % inch.

In some embodiments, a distal end 104 of the auger member's shaft 102 may be pointed and/or chamfered to decrease frictional engagement with the ground or otherwise facilitate boring of the auger member 108 into the ground. A proximal end of the shaft 102 may likewise be pointed, tapered, or chamfered to facilitate insertion of the proximal end within the inner lumen of the main shaft component 114. In some embodiments, the bottom end 104 may be open and hollow to allow displaced dirt and/or sand to extend upward into the shaft 102 upon boring of the auger member 108 into the ground.

A first auger blade 106*a* and a second auger blade 106*b* are fixedly attached to the shaft 102. The auger blades 106 extend circumferentially around at least a portion of the shaft 102 in a helical configuration, such that rotation of the shaft 102 causes the auger member 108 to bore into the ground. The auger blades 106 may be welded to an exterior surface of the shaft 102 and/or attached via any other means known in the art, such as adhesives, fasteners, and the like.

The two auger blade arrangement illustrated in the drawings may provide several advantages over conventional auger devices. For example, when the two auger blades, 106*a* and 106*b*, are separated by an axial gap, the first auger blade 106*a* and the second auger blade 106*b* may create a suction or vacuum force in the sand or ground between the two blades that results in a more stable anchor point than can be achieved with a single auger blade. In some embodiments, the auger blades 106 may have a diameter of between 2 and 10 inches, and more commonly between about 4 and 6 inches. The auger blades, 106*a* and 106*b*, may have a spacing (i.e., axial gap) of between about 4 and 10 inches, and more commonly about 8. inches.

Although a two blade arrangement is illustrated, it should be realized that in other embodiments a single auger blade or three or more auger blades may be used. In embodiments that employ a single auger blade, the auger blade may wrap a single time around the shaft 102 or multiple times around the shaft 102 as desired. In addition, although circular auger blades are illustrated, it should be realized that various other auger blade shapes may be employed, such as triangles, squares, pentagons, hexagons, and the like. With the use of a square cross-section shaft 102 and circular inner edges of the auger blades 106, certain regions of the blade's inner edges may not contact the exterior surface of the shaft 102. For example, the inner edges of the augers blades may only contact the corners of the square exterior surface of the shaft 102.

The auger blades 106 may be placed at any axial position along the shaft 102. For example, in some embodiments the first auger blade 106*a* may be attached near the proximal end of the shaft 102 and the second auger blade 106*b* may be attached near the distal end of the shaft 102. In other embodiments, both auger blades 106 may be attached near the proximal end of the shaft 102 or near the distal end of the shaft.

An attachment member 116 is attached near the proximal end of the shaft 102. The attachment member 116 provides an attachment point for the securement member 118. In the illustrated embodiment, the attachment member 116 is an eye bolt. In other embodiments, the attachment member 116 may be a strap, a hook, a rope, a chain, an adhesive, or any other known attachment mechanism. The attachment member 116 is attached to the shaft so that it protrudes laterally outward from the exterior of the shaft. The attachment member 116 is also positioned axially below a shaft guard 124. An advantage of the laterally protruding attachment member 116 is that the attachment member 116 is positioned away from and axially below the proximal end of the shaft 102 where it does not interfere with coupling of the handle member 110 and the auger member 108. The position of the attachment member 116 also allows the securement member 118 to remain coupled to the attachment member 116 while the handle member 110 is coupled with and uncoupled from the auger member. The position also ensure that the securement member 118 does not interfere with coupling of these components.

As briefly described above, the handle member 110 may be removed from the auger member 108 after the auger member is bored into the ground. This configuration provides several advantages over conventional devices. For example, in aqueous environments, the auger member 108 may be bored into the ground so that it is well below the surface of the water, which eliminates the risk of the watercraft colliding with or contacting the auger member 108 due to wind shifts, erratic wave patterns, tidal changes, and/or other issues. This prevents the auger member 108 from accidentally damaging the watercraft. The handle member 110 may also be removed so that it does not pose a tripping risk to users in and around the auger member 108.

The removability of the handle member also minimizes the lever arm that is created when an object is coupled with the auger member 108. For example, the auger member 108 may be bored into the ground so that the attachment member 116 is positioned directly adjacent and/or close to the ground. The handle member 110 may then be removed so that the auger member 108 remains with the attachment member 116 positioned close to the ground. An object may then be attached to the attachment member 116 and anchored or tethered to the ground. Since the handle member 110 is removed, the handle member 110 does not function as a lever that may place undue stress on the auger member 108. In contrast, conventional devices commonly include an anchor point that is positioned at or near the top of the device. When the device is anchored into the ground, the top of the device that includes the anchor point commonly extends well above the ground. As a result, the top of the device may act as a lever arm when external forces are applied, such as high winds, excessive waves, and the like. The increased leverage due to the lever arm may cause the device to be pulled, removed, or otherwise unintentionally detach from the ground. In the instant case, since the attachment member 116 is positioned near the ground, essentially no lever arm is created.

In some embodiments, the position of the attachment member 116 may be adjusted along the axial length of the shaft 102 as desired. The adjustment of the attachment member 116 may increase or decrease the lever arm as desired. For example, in relatively rigid soils that are difficult to bore into, the attachment member 116 may be adjusted axially downward toward the distal end of the shaft 102. In some embodiments, the attachment member 116 may be attached to the shaft 102 at a location that is within 5%, 10%, 15%, 20%, or 25% of the proximal end of the shaft 102.

As illustrated in FIG. 2, a shaft guard 124 is attached to the proximal end of the shaft 102 axially above the attachment member 102. The shaft guard 124 is configured to circumferentially surround and enclose the distal end of the main shaft component 114. The shaft guard 124 has a conical shape (e.g., conical interior and/or exterior surface) with an open end that faces the distal end of the main shaft component 114 and an attached end that attaches to the shaft 102. The shaft guard 124 is positioned along the shaft 102 so that the conical shape directs the distal end of the main shaft component 114 into mating engage with the proximal end of the shaft 102. The conical shape of the shaft guard 124 may be especially useful in aqueous environments where it greatly aids in coupling the main shaft component 114 and shaft 102. For example, the user may merely need to position the distal end of the main shaft component 114 within the shaft guard 124 and then push the main shaft component 114 axially downward to matingly engage the distal end of the main shaft component 114 and the proximal end of the shaft 102. In some embodiments, the shaft guard 124 may have a vibrant color that may be easily seen from the surface of the water. In some embodiments, the shaft guard 124 is made of plastic, although a variety of materials may be used.

A proximal end of the shaft guard 124 is positioned axially outward of the proximal end of the shaft 102 so that the proximal end of the shaft 102 is surrounded by and axially enclosed within the shaft guard 124. Stated differently, the proximal end of the shaft 102 does not extend beyond a plane that is defined by and parallel with the proximal end of the shaft guard 124. This configuration enables the shaft guard to protect a user from stepping on, or otherwise accidentally contacting, the pointed proximal end of shaft 102 after the auger member 108 is bored into the ground. This feature may be especially useful in murky water.

The shaft guard 124 may be between 2 and 10 inches, and more commonly about 6 inches in length. The shaft guard 124 may be attached to the shaft 102 via one or more mechanical fasteners, via adhesive bonding, various forms of welding, and the like.

Figure 3:
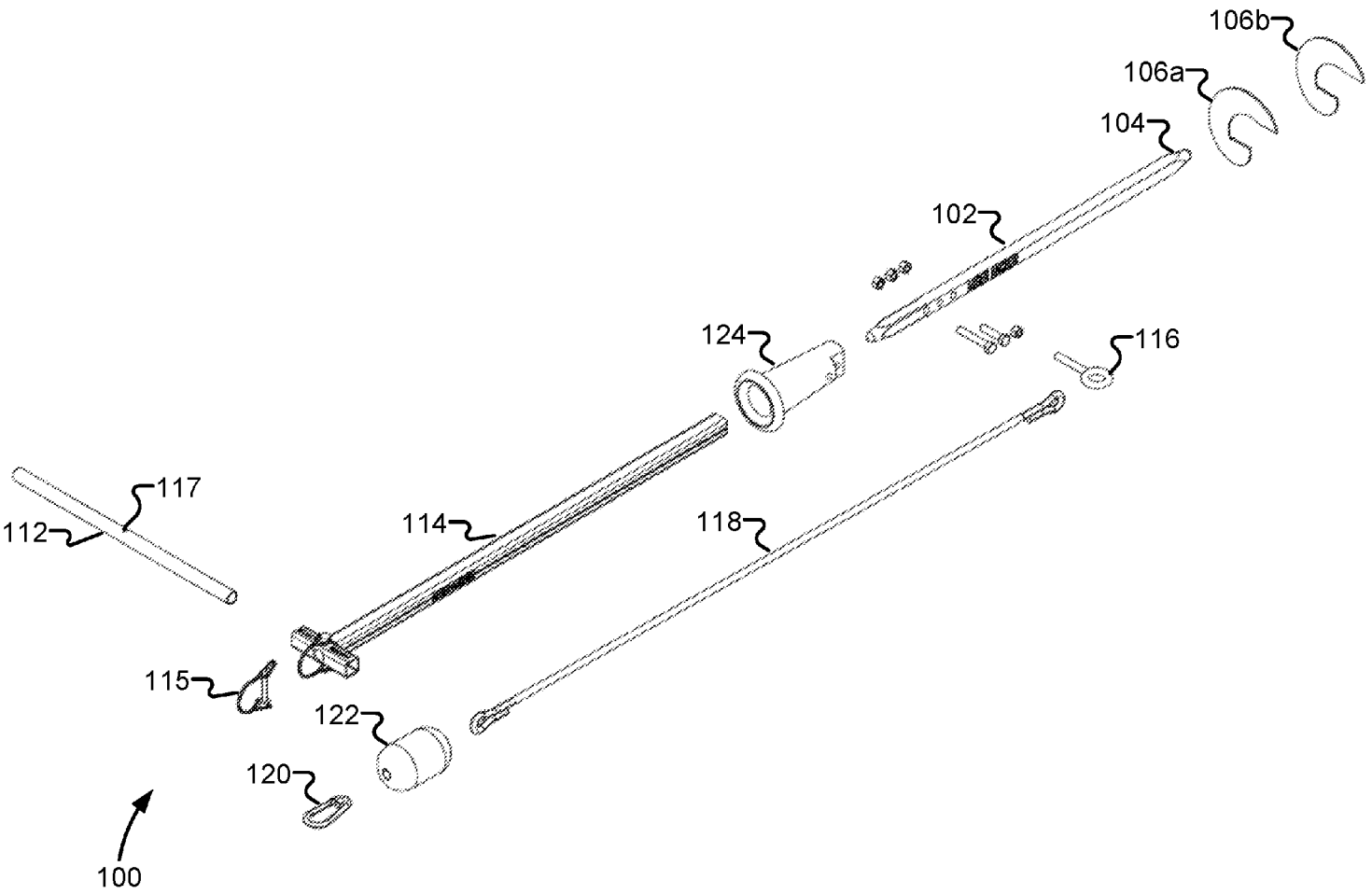
FIG. 3 illustrates an exploded, perspective view of the anchor device of FIG. 1.

FIG. 3 illustrates an exploded, perspective view of the anchor device 100 showing the various components described above in a disassembled state. The proximal end of the shaft 102 is visible in FIG. 3, which may be pointed, tapered, or chamfered to more easily engage with the bottom of the main shaft component 114. FIG. 3 further illustrates the grip component 112 uncoupled from the main shaft component 114. As illustrated the grip component 112 may include an aperture 117 that aids in attaching the grip component 112 to the main shaft component 114, as described in reference to FIGS. 4A and 4B.

Figure 4A:
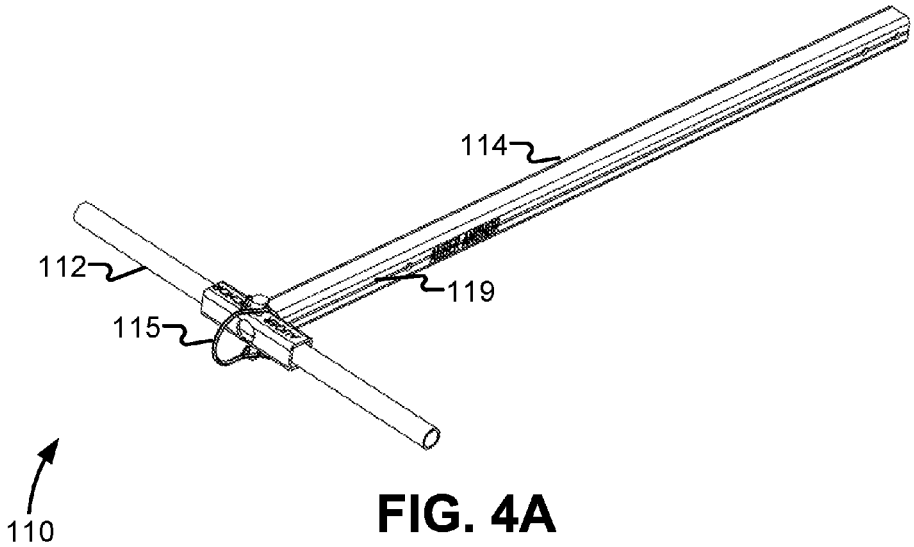
FIGS. 4A and 4B illustrate perspective views of a handle member of the anchor device of FIG. 1.
Figure 4B:
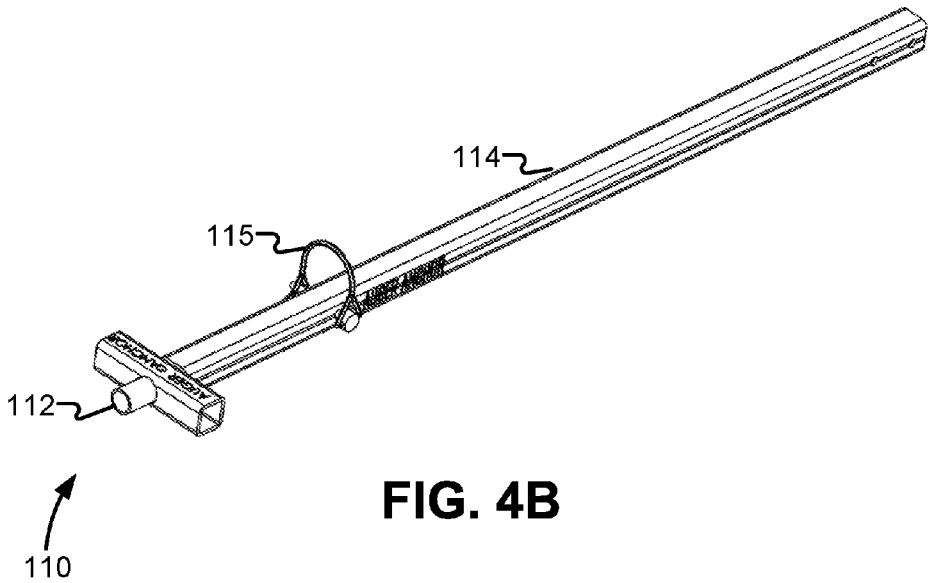

FIGS. 4A and 4B illustrate perspective views of the handle member 110. Referring first to FIG. 4A, the handle member 110 is illustrated in an assembled state in which the grip component 112 is inserted within a hollow tube or cylinder attached to a proximal end of the main shaft component 114. A locking pin 115 is inserted through an aperture in the hollow tube or cylinder and through the aperture 117 in the grip component to couple the two components together.

Referring now to FIG. 4B, the handle member 110 is illustrated in a disassembled, or stored state, in which the grip component 112 is removed from the hollow tube or cylinder and is instead inserted axially into the main shaft component 114, which may be hollow so as to receive the grip component 112. The locking pin 115 is inserted through both an aperture 119 in the main shaft component 114 and through the aperture 117 in the grip component 112 to secure the grip component 112 within the main shaft member 114. While disassembled, the handle member 110 occupies a minimal amount of space and may be easily stored in the watercraft 150 or elsewhere as desired.

Figure 5:
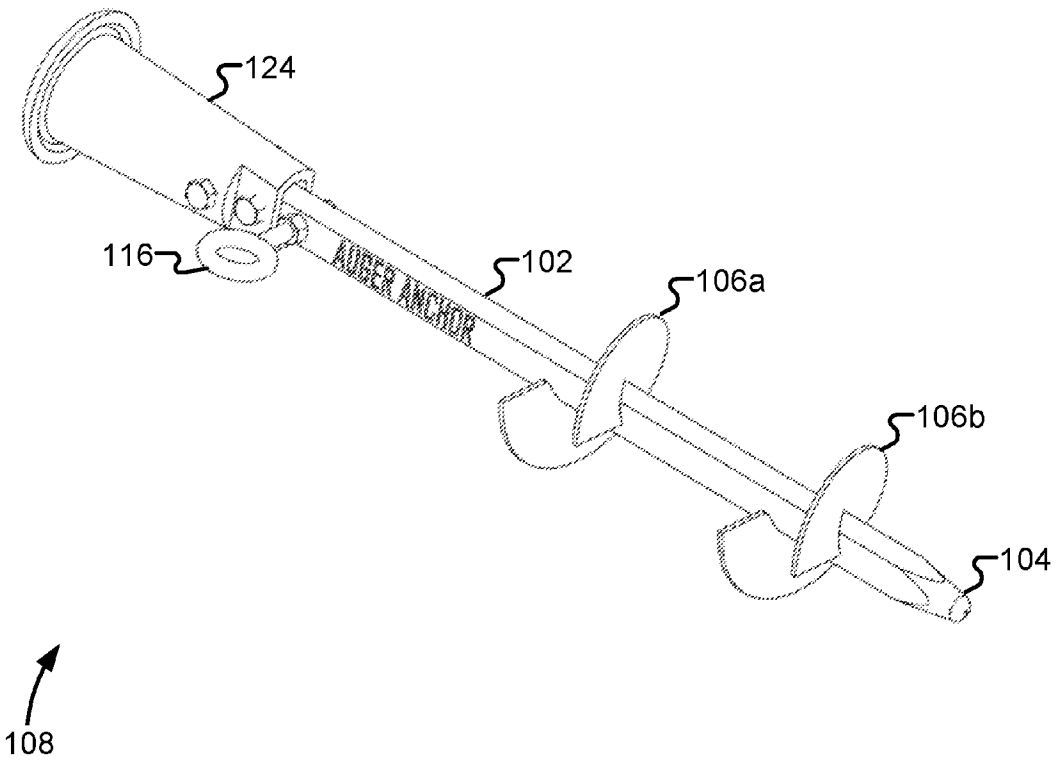
FIG. 5 illustrates a perspective view of an auger member of the anchor device of FIG. 1.

FIG. 5 illustrates a perspective view of the auger member 108 and the various components of the auger member described herein.

Figure 6A:
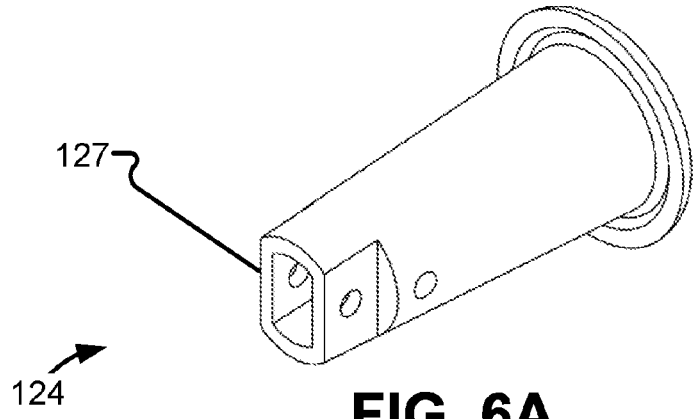
FIGS. 6A, 6B, and 6C illustrate a perspective view, a top view, and a bottom view of a shaft guard of the anchor device of FIG. 1.
Figure 6B:
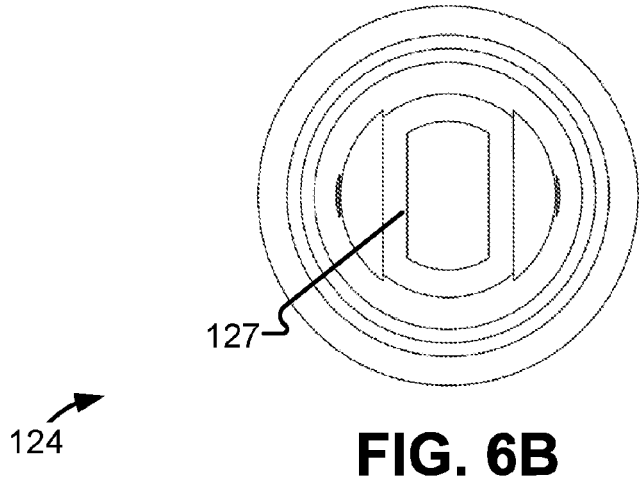
Figure 6C:
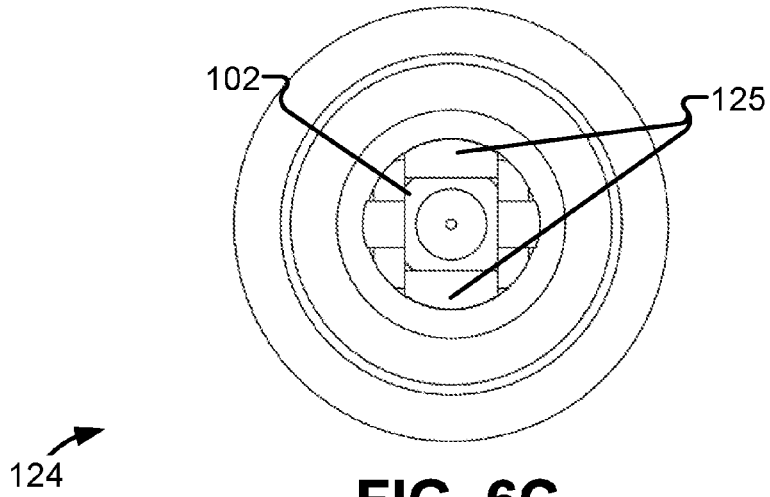

FIGS. 6A, 6B, and 6C illustrate various views of the shaft guard 124. As previously described, the shaft guard 124 may be attached to the shaft 102 via fastening bolts and nuts (as shown in FIG. 2), or it may be attached using any one of a wide range of attachment mechanisms. When mechanical fasteners are employed, typically multiple fasteners are used to firmly anchor the shaft guard 124 to the shaft 102 and prevent relative motion between the components. The open end and conical inner surface of the shaft guard 124 are illustrated in FIG. 6C. The conical inner surface of the shaft guard 124 directs the distal end of the main shaft component 114 into mating engagement with the top end of the shaft 102. The design greatly aids a user aligning and coupling the handle member 110 and auger member 108. In addition to aiding in mating engagement of the handle member 110 and auger member 108, the shaft guard 124 may also engage with or contact the distal end of the handle member to arrest insertion of the auger member 108 within the handle member 110.

As illustrated in FIGS. 6A-C, the distal end of the shaft guard 124 includes a coupling aperture 127 having a roughly rounded rectangular shape. As illustrated in FIG. 6C, a first pair of opposing sides of the coupling aperture 127 are planar and configured to sit flush against shaft 102 when the shaft 102 is inserted through the coupling aperture 127. A second pair of opposing sides are curved or arcuate so that when the shaft 102 is inserted through the coupling aperture 127, one or more drainage slots 125 are formed. The drainage slots 125 are apertures or other openings that allow fluid access to an interior region of the shaft guard 124 from axially below the shaft guard 124. The drainage slots 125 allow draining of water, sand, or dirt that has accumulated inside the shaft guard 124 during use.

Although the shaft guards 124 are illustrated as including drainage slots 124, in some embodiments the shaft guards 124 do not include drainage slots, or the shaft guard 124 includes a greater number of smaller drainage slots, such as a series of small drilled holes along the outside of the shaft guard 124. In addition, while the shaft guard 124 is illustrated as being attached to the proximal end of the auger member 108, in other embodiments the shaft guard 124 is attached to the distal end of the handle member 110. In such embodiments, the open end of the shaft guard 124 faces axially downward toward the distal end of the main shaft component 114 and directs the proximal end of the shaft 102 into mating engagement with the distal end of the main shaft component 114.

Figure 7:
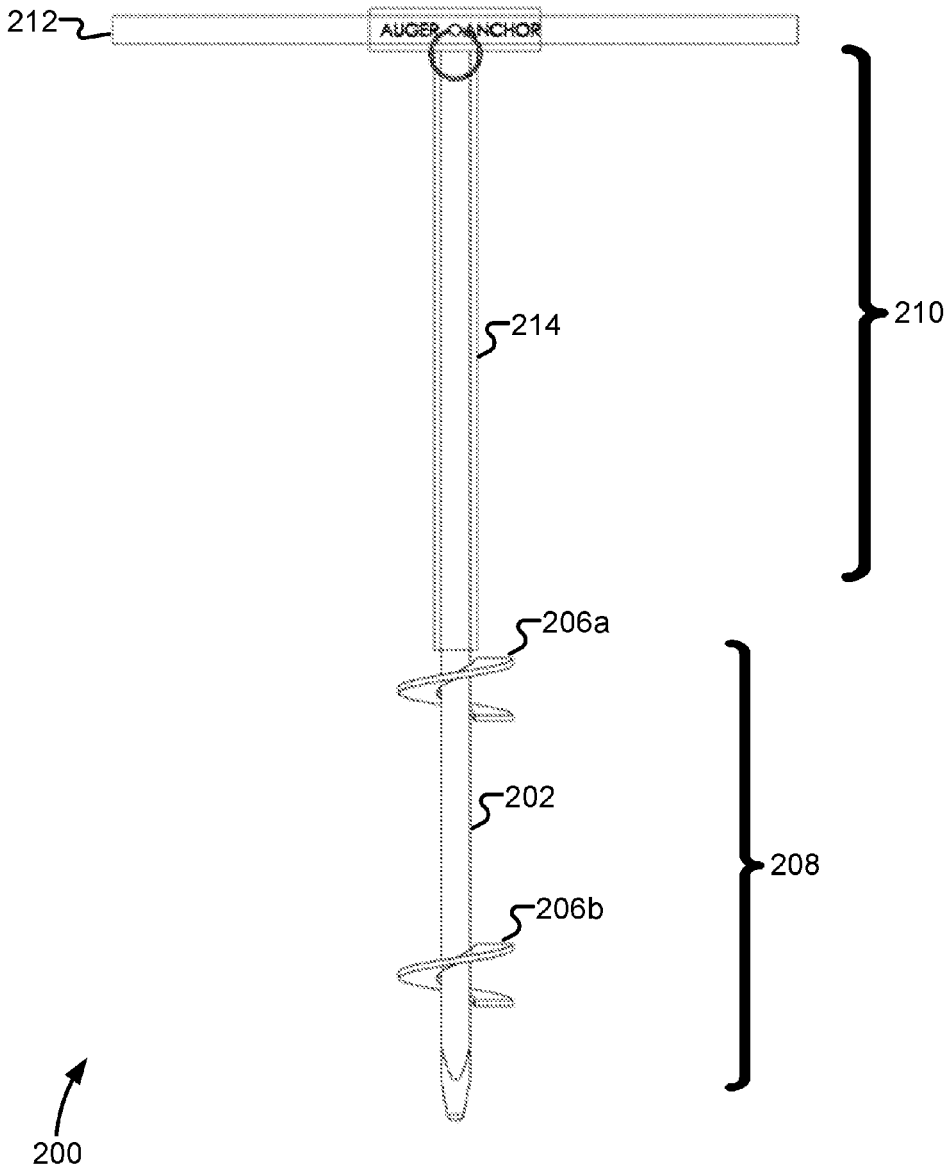
FIG. 7 illustrates a front view of an anchor device, according to another embodiment of the present disclosure.

FIG. 7 illustrates a front view of another anchor device 200. The anchor device 200 includes a handle member 210 and an auger member 208. The handle member 210 includes a grip component 212 and a main shaft component 214 as previously described. The auger member 208 includes a first auger blade 206*a* and a second auger blade 206*b* that are positioned on a shaft 202 with an axial gap. The function and operation of the anchor device 200 may be similar to that of the previously described anchor device 100. One notable difference between the two devices is the absence of a shaft guard. The handle member 210 may or may not be removable from the auger member 208. An overall axial length of the anchor device 200 may be significantly less than that of the previous described anchor device 100. As such, the anchor device 200 of FIG. 7 may find particular usefulness in anchoring smaller objects to the ground and/or other situations where a more compact device is needed.

Figure 8:
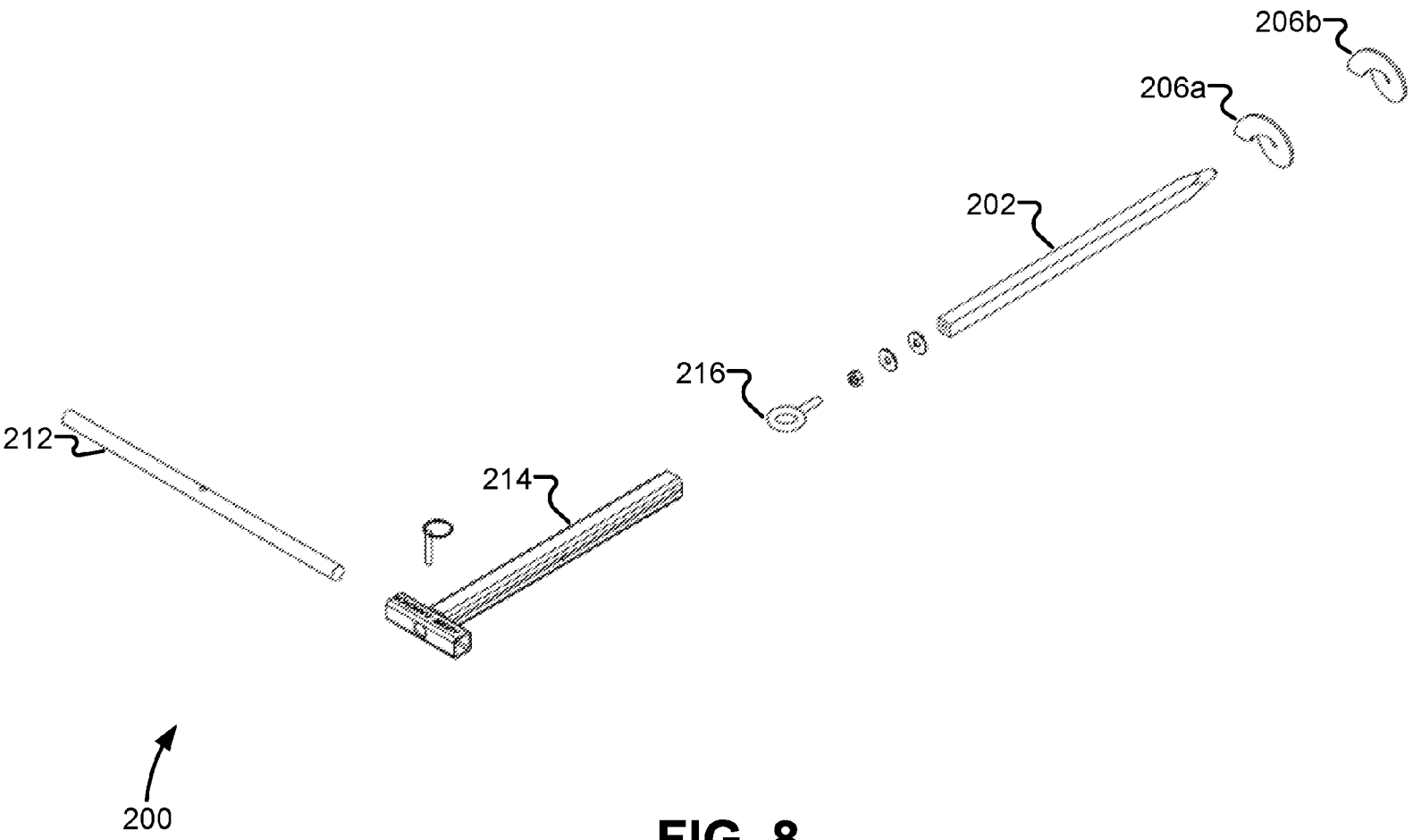
FIG. 8 illustrates an exploded, perspective view of the anchor device of FIG. 7.

FIG. 8 illustrates an exploded, perspective view of the anchor device 200. The anchor device 200 lacks a shaft guard and/or an attachment member that extends orthogonally outward from the shaft 202. Instead, the anchor device 200 includes an attachment member 216 that extends axially upward from the proximal end of the shaft 202. The main shaft component 214 of the handle member 210 is configured to cover and conceal the attachment member 216 when it matingly engages with the shaft 202.

Figure 9:
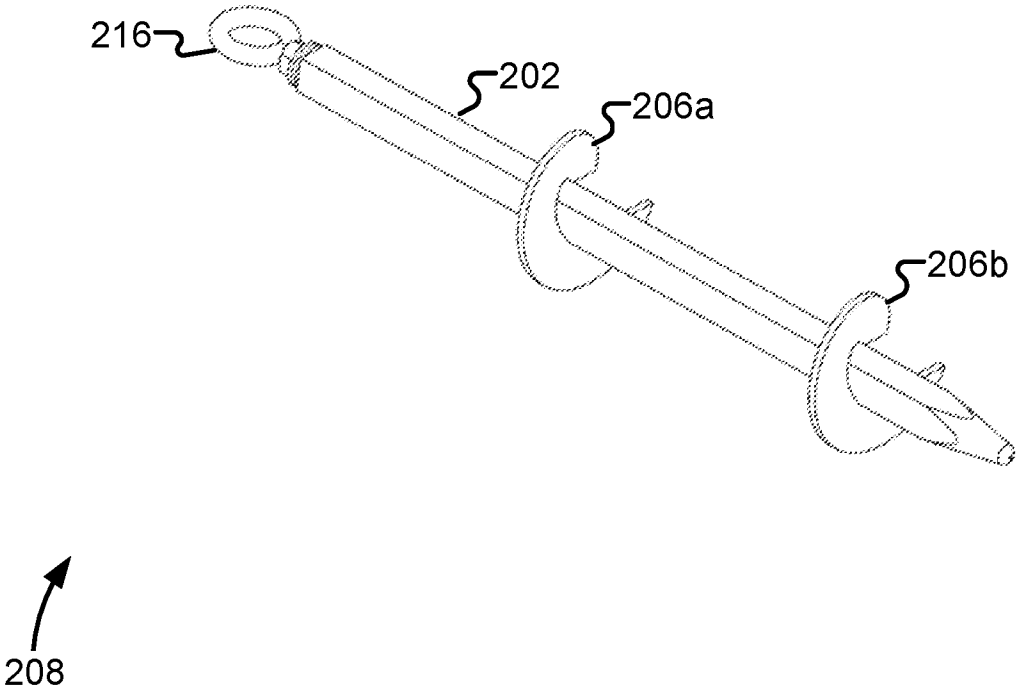
FIG. 9 illustrates a perspective view of an auger member of the anchor device of FIG. 7.

FIG. 9 illustrates a perspective view of the auger 208. The shaft 202 may be, shorter than the shaft 102 of the previously described anchor device 100. In some embodiments, the shaft 202 may have an axial length of between 6 and 15 inches, and more commonly about 12 inches.

In aqueous environments, the above described anchor devices may be used as follows. The anchor device may be assembled with the handle member attached to the auger member. The distal end of the auger member may then be submerged in the water and positioned in contact with the bed or floor of the body of water. The grip component of the handle member may then be rotated in the appropriate direction (e.g., clockwise or counter-clockwise) to bore the auger member into the ground. Once the auger member is secured into the ground (which may be when both auger blades are below the ground and/or with the attachment member positioned close to the ground), the handle member is then removed or detached from the auger member, such as by lifting the handle member vertically. The connector (e.g., caribiner) that is attached to the distal end of the securement member (e.g., rope) may then be fastened to the watercraft (unless this step was previously performed). The grip component may then be removed from the main shaft component and stored within the hollow interior of the main shaft component.

To detach the auger member from the ground, the handle member is lowered vertically to reengage it with the auger member. This process may be greatly aided via the shaft guard directing the distal end of the handle member into mating engagement with the auger member. The grip component is then rotated in the appropriate direction (e.g., clockwise or counter-clockwise depending on the direction to bore the auger member into the ground) to cause the auger blades to recede or be extracted from within the ground.

Figure 10:
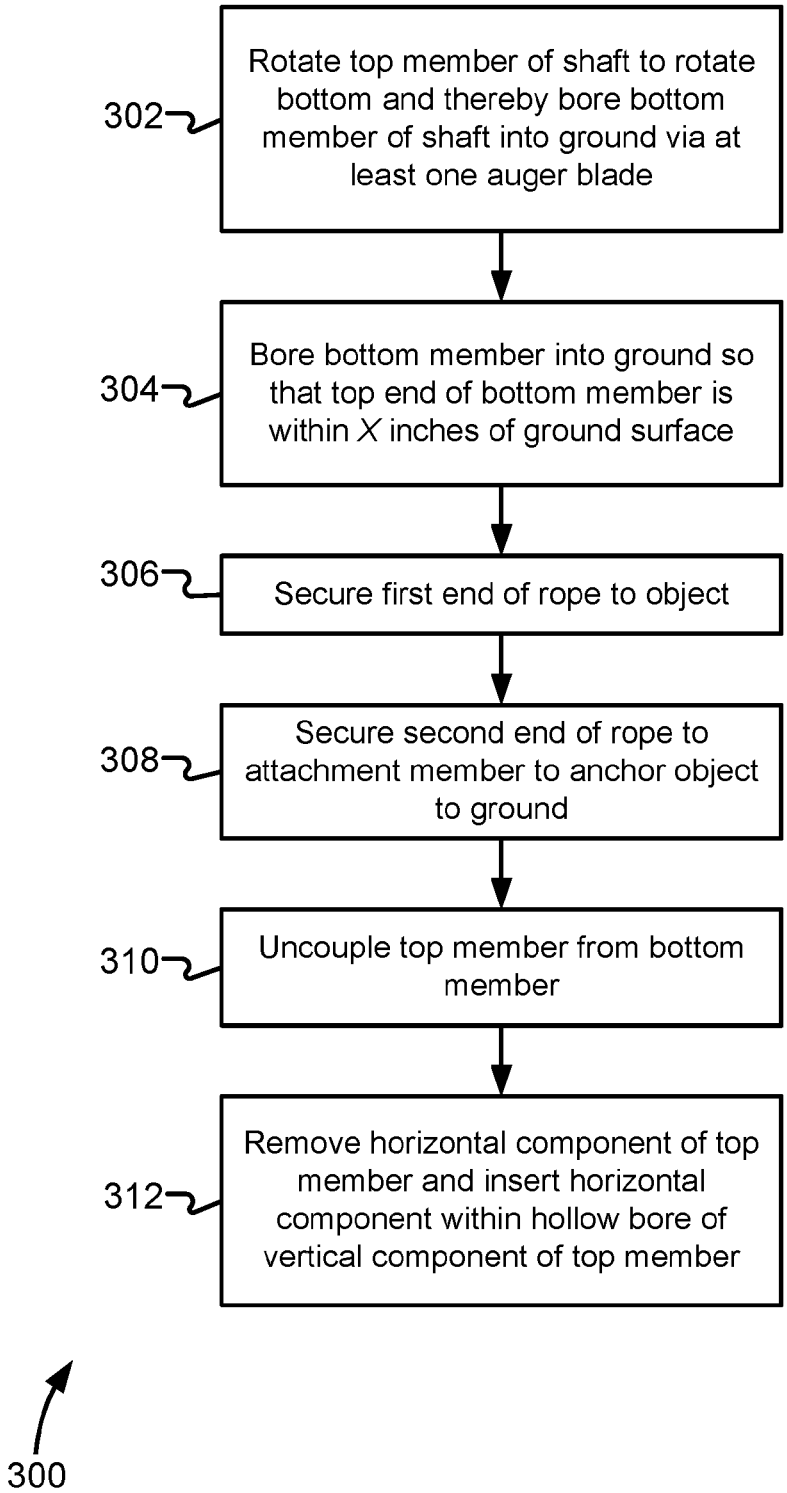
FIG. 10 illustrates a method of anchoring an object via an anchor device.

FIG. 10 illustrates a method 300 of anchoring an object using an anchor device. As described herein, the anchor device may include a shaft having a bottom member (e.g., auger member) and a top member (e.g., handle member) that is removably coupleable with the bottom member. The anchor device may also include at least one auger blade that is attached to the bottom member of the shaft near a bottom end thereof. The at least one auger blade may extend circumferentially around the shaft in a helical configuration or fashion. An attachment member may be attached to the shaft near a top end of the bottom member.

At step 302, a user may rotate the top member of the shaft to rotate the bottom member and thereby bore the bottom member of the shaft into the ground via the at least one auger blade. At step 304, the user may bore the bottom member into the ground so that a top end of the bottom member is within X inches of the ground surface. The value of X may vary depending on the specific embodiment and the size of the object (e.g., watercraft 150) being anchored to the ground. In some embodiments, the user may bore the bottom member into the ground so that the top end of the bottom member is within 10 inches of the ground surface. In other embodiments, the value of X may be more or less than this, such as 2 inches, 3 inches, 4 inches, 6 inches, 8 inches, 12 inches, 14 inches, and the like.

At step 306, the user may secure a first end of a rope to the object. At step 308, the user may secure a second end of the rope to the attachment member to anchor the object to the ground. At step 310, the user may uncouple the top member from the bottom member. At step 312, the user may remove a horizontal component (e.g., grip component) of the top member from a vertical component (e.g., main shaft component) of the top member and insert the grip component within the hollow bore of the main shaft component. Steps of the method 600 need not be performed in the order listed, or in any particular order. Furthermore, some steps of the method 600 may be omitted when performing the method 600.

Having described several example configurations, various modifications, alternative constructions, and equivalents may be used without departing from the spirit of the disclosure. For example, the above elements may be components of a larger system, wherein other rules may take precedence over or otherwise modify the application of the technology. Also, a number of steps may be undertaken before, during, or after the above elements are considered. Accordingly, the above description does not bind the scope of the claims.

As used herein and in the appended claims, the singular forms "a", "an", and "the" include plural references unless the context clearly dictates otherwise. Thus, for example, reference to "a user" includes a plurality of such users, and reference to "the processor" includes reference to one or more processors and equivalents thereof known to those skilled in the art, and so forth.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

What is claimed is:

1. An anchor device for anchoring one or more objects to the ground, the anchor device comprising:

a shaft having a bottom end and a top end, wherein the top end of the shaft comprising a square cross-section, and wherein the bottom end of the shaft is pointed;

a handle member that is removably attached to the top end of the shaft, the handle member being operable by a user to rotate the shaft, the handle member comprising a square cross-section that matingly engages with the square cross section of the top end of the shaft;

a first auger blade attached to the shaft near the bottom end thereof, the first auger blade extending circumferentially around the shaft in a helical configuration;

a second auger blade attached to the shaft near the top end thereof, the second auger blade extending circumferentially around the shaft in a helical configuration, the second auger blade being separated from the first auger blade by an axial gap;

an attachment member attached to the shaft near the top end of the shaft, the attachment member being attachable to a tether; and a shaft guard attached to the shaft so as to surround the top end of the shaft without covering the top end such that the handle member is matingly engagable with the top end of the shaft while the shaft guard is attached to the shaft;

wherein the shaft, the first auger blade, and the second auger blade form an auger that is capable of boring into the ground upon rotation of the shaft to create a static anchor point for an object attached to the tether.

2. The anchor device of claim 1, wherein the shaft guard has a conical shape with an open end that is positioned toward the top end of the shaft and an opposite end that attaches to the shaft, the shaft guard being positioned about the shaft so that the conical shape directs the handle member to matingly engage with the top end of the shaft.

3. The anchor device of claim 2, wherein the opposite end of the shaft guard includes an aperture or other opening that allows fluid access to an interior region of the shaft guard from axially below the attached end.

4. The anchor device of claim 1, wherein the handle member includes a horizontal component and a vertical component, the vertical component having a top end and a bottom end that includes the square cross-section, wherein the horizontal component is removably coupleable with the vertical component to form a handle that is graspable by a user to rotate the shaft.

5. The anchor device of claim 4, wherein the vertical component includes a hollow interior within which the horizontal component is insertable.

6. The anchor device of claim 1, wherein the attachment member is coupled with the shaft so as to extend orthogonally from the shaft.

7. The anchor device of claim 6, wherein the attachment member comprises an eye bolt.

8. The anchor device of claim 7, wherein the tether is a rope having a first end and a second end, wherein the first end of the rope is secured to the eye bolt and the second end of the rope is securable to the object.

9. The anchor device of claim 1, wherein the shaft include a square cross-section along its entire axial length and wherein at least a portion of an inner edge of the first auger blade and the second auger blade do not contact an outer surface of the shaft.

10. An anchor device for anchoring one or more objects to the ground, the anchor device comprising:

a shaft having a bottom member and a top member that is removably coupleable with the bottom member, the top member defining a handle that is operable by a user to rotate the bottom member;

at least one auger blade that is attached to the bottom member of the shaft near a bottom end thereof, the at least one auger blade extending circumferentially around the shaft in a helical configuration;

an attachment member attached to the shaft near a top end of the bottom member of the shaft, the attachment member being attachable to a tether; and a shaft guard attached to the bottom member of the shaft so as to surround the top end of the bottom member without covering the top end such that the top member is matingly engagable with the top end of the bottom member while the shaft guard is attached to the bottom member;

wherein the bottom member of the shaft and the at least one auger blade form an auger that is capable of boring into the ground upon rotation of the bottom member to create a static anchor point for an object attached to the tether.

11. The anchor device of claim 10, further comprising an additional auger blade attached to the bottom member of the shaft, the additional auger blade extending circumferentially around the shaft in a helical configuration, the additional blade being separated from the at least one auger blade by an axial gap.

12. A method of anchoring an object, the method comprising:

an anchor device comprising:

a shaft having a bottom member and a top member that is removably coupled with the bottom member;

at least one auger blade that is attached to the bottom member of the shaft near a bottom end thereof, the at least one auger blade extending circumferentially around the shaft in a helical configuration;

an attachment member attached near a top end of the bottom member of the shaft; and a shaft guard attached to the bottom member of the shaft so as to surround the top end of the bottom member without covering the top end of the bottom member such that the top member is matingly engagable with the top end of the bottom member while the shaft guard is attached to the bottom member;

rotating the top member of the shaft to rotate the bottom member and thereby bore the bottom member of the shaft into the ground via the at least one auger blade;

securing a first end of a tether to the object; and securing a second end of the tether to the attachment member to anchor the object to the ground.

13. The method of claim 12, further comprising uncoupling the top member from the bottom member.

14. The method of claim 12, wherein the bottom member of the shaft is bored into the ground so that a top end of the bottom member is within 10 inches of the ground surface.

15. The method of claim 12, further comprising removing a horizontal component of the top member and inserting the horizontal component within a hollow interior of a vertical component of the top member.

16. The method of claim 12, wherein the anchor device further comprises an additional auger blade attached to the bottom member of the shaft, the additional auger blade extending circumferentially around the shaft in a helical configuration, the additional blade being separated from the at least one auger blade by an axial gap.

* * * * *